US009354019B2

(12) United States Patent
Gonzaga

(10) Patent No.: US 9,354,019 B2
(45) Date of Patent: May 31, 2016

(54) ELECTROMAGNETIC TUBE GUN

(71) Applicant: Ernesto Aguilar Gonzaga, North Las Vegas, NV (US)

(72) Inventor: Ernesto Aguilar Gonzaga, North Las Vegas, NV (US)

( * ) Notice: Subject to any disclaimer, the term of this patent is extended or adjusted under 35 U.S.C. 154(b) by 0 days.

(21) Appl. No.: 14/706,833

(22) Filed: May 7, 2015

(65) Prior Publication Data

US 2015/0323281 A1 Nov. 12, 2015

Related U.S. Application Data

(60) Provisional application No. 61/989,638, filed on May 7, 2014.

(51) Int. Cl.
*F41B 6/00* (2006.01)

(52) U.S. Cl.
CPC ..... *F41B 6/006* (2013.01)

(58) Field of Classification Search
CPC ..... F41B 6/006; F41B 6/00; F41B 6/003
USPC ..... 124/3
See application file for complete search history.

(56) References Cited

U.S. PATENT DOCUMENTS 4,319,168 A * 3/1982 Kemeny ..... F41B 6/006 104/282
4,329,971 A * 5/1982 Kemeny ..... F41B 6/006 124/3
4,369,692 A * 1/1983 Kemeny ..... F41B 6/006 124/3
4,423,662 A * 1/1984 McAllister ..... F41B 6/006 124/3
4,485,720 A * 12/1984 Kemeny ..... F41B 6/006 102/520
4,930,395 A * 6/1990 Loffler ..... F42B 30/00 102/526
5,168,118 A * 12/1992 Schroeder ..... F42B 6/006 124/3
5,237,904 A * 8/1993 Kuhlmann-Wilsdorf F41B 6/006 102/517
8,302,584 B1 * 11/2012 Lu ..... F41B 6/003 124/3
2007/0277668 A1 * 12/2007 Frasca ..... F41B 6/00 89/8
2008/0000380 A1 * 1/2008 Dryer ..... F41B 6/00 102/520
2015/0323281 A1 * 11/2015 Gonzaga ..... F41B 6/006 124/3

* cited by examiner

*Primary Examiner* — Samir Abdosh

(57) ABSTRACT

An electromagnetic tube gun is a device for launching a projectile through kinetic energy. The device features a first conductive rail with a first electrical current, a second conductive rail with a second electrical current, an at least one conductive sheet with a cross current, and a magnetic field induction coil with a third electrical current. The at least one conductive sheet connects the first conductive rail and the second conductive rail. The magnetic field induction coil is positioned within a projectile case and placed between the first conductive rail and the second conductive rail. A rail power supply is connected to the first conductive rail and the second conductive rail while a coil power supply is connected to the magnetic field induction coil. Magnetic induction generated by the magnetic field induction coil interacts with the cross current in order to generate a Lorentz force that launches the projectile case.

20 Claims, 7 Drawing Sheets

SECTION B-B

ELECTROMAGNETIC TUBE GUN

The current application claims a priority to the U.S. Provisional Patent application Ser. No. 61/989,638 filed on May 7, 2014.

FIELD OF THE INVENTION

The present invention relates generally to an electromagnetic accelerator. More specifically, the present invention is an electromagnetic tube gun for creating projectile motion within a barrel via Lorentz force.

BACKGROUND OF THE INVENTION

Electromagnetic launchers (EML), commonly referred to as railguns, operate by generating projectile motion through an electromagnetic force known as Lorentz force. A conventional electromagnetic launcher comprises a first conducting rail and a second conducting rail that are oriented parallel to each other as well as a direct current (DC) power supply that is connected to one end of each conducting rail. Two currents travel in opposite directions to each other through the first conducting rail and the second conducting rail. A sliding conductive armature bridges the gap in between the two conducting rails and remains in contact with the two conducting rails, completing the circuit. A projectile is placed in between the conducting rails and is driven by the conductive armature. The conductive armature may be integral to the projectile. Lorentz force is generated by the interaction between the electric current in the accelerated sliding armature and the magnetic induction field (B-field) generated by the flow of current in the closed loop. Because the electric current in the conductive armature and the B-field are oriented at a right angle relative to each other, the Lorentz force is maximized and oriented normal to the plane of electric current and B-field intensity. As such, the projectile is launched in a straight line parallel to the pair of conducting rails at a high muzzle velocity suitable for straight free flight.

Electromagnetic accelerators are particularly notable in military applications due to the much greater achievable muzzle velocities relative to conventional firearms using chemical propellants. However, there are several drawbacks that are inherent to the aforementioned mechanism used by conventional electromagnetic launchers. One such drawback is the energy loss and inefficiency due to mechanical friction between the conducting rails and the conductive armature, electric arcing due to increasing distance between the conducting rails, and thermal expansion of the conducting rails and the projectile. Proper heat dissipation is particularly important as well as extreme heat may result in degradation of equipment material and system failure during operation.

The present invention is a dynamic B-field accelerator that addresses the drawbacks that are inherent to conventional electromagnetic accelerators. The present invention eliminates the need for the conductive armature in between the conducting rails. In lieu of the conductive armature, the present invention implements a power supply and a solenoid coil with ferromagnetic core that are integrated into a projectile that is positioned in between a pair of conducting rails. Electric current within the conducting rails travels from the first conducting rail to the second conducting rail through an upper conducting sheet above the projectile and a lower conducting sheet below the projectile. The coil is offset by a short distance above the plane of the lower conducting sheet and a short distance below the plane of the upper conducting sheet, enabling the coil to move. Lorentz force is generated by the interaction of the current in the conducting sheet directly under the coil with the central B-field generated by the current within the coil. External magnetic induction outside the coil is present in the opposite direction to the central B-field. However, the central B-field is much stronger than the external magnetic induction, in essence negating the external magnetic induction in both force and direction.

DETAIL DESCRIPTIONS OF THE INVENTION

All illustrations of the drawings are for the purpose of describing selected versions of the present invention and are not intended to limit the scope of the present invention.

Figure 1:
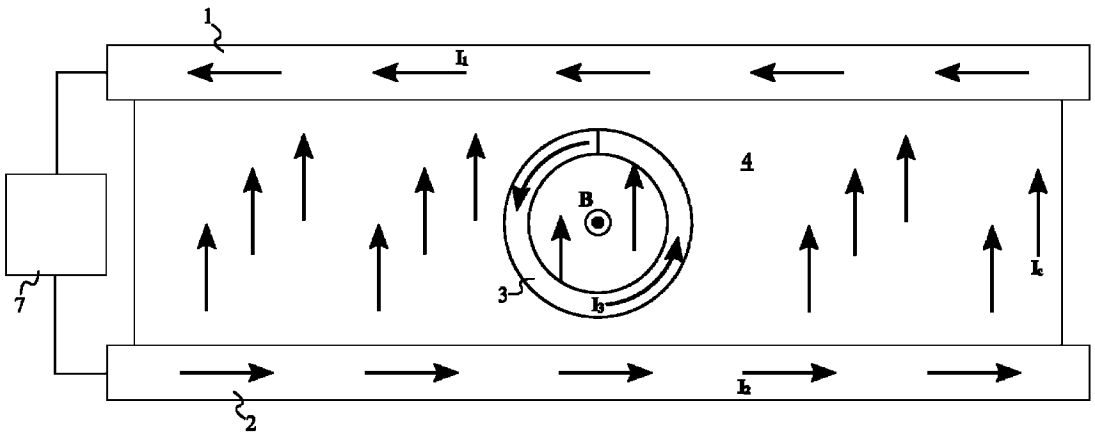
FIG. 1 is a top view electrical schematic diagram of the present invention.

The present invention is an electromagnetic tube gun for creating projectile motion through Lorentz force. With reference to FIG. 1, the present invention comprises a first conductive rail 1, a second conductive rail 2, a magnetic field induction coil 3, and an at least one conductive sheet 4. A first electrical current $I_1$ travels along the first conductive rail 1 while a second electrical current 12 travels along the second conductive rail 2 and travels in an opposite direction to the first electrical current $I_1$. A cross current $I_c$ travels across the at least one conductive sheet 4 and travels in a perpendicular direction to both the first electrical current $I_1$ and the second electrical current $I_2$. The first conductive rail 1 is electrically connected to the second conductive rail 2 by the at least one conductive sheet 4 and additionally, the at least one conductive sheet 4 is positioned in between the first conductive rail 1 and the second conductive rail 2. Consequently, electrical current is able to travel through the first conductive rail 1, across the at least one conductive sheet 4, and through the second conductive rail 2. As such, the first conductive rail 1, the second conductive rail 2, and the at least one conductive sheet 4 form a single loop of current. In the preferred embodiment of the present invention, the magnetic field induction coil 3 is a solenoid with ferromagnetic coil. A third electrical current $I_3$ travels around the magnetic field induction coil 3 and generates a magnetic field B oriented normal to and away from the at least one conductive sheet 4.

This magnetic field B in the magnetic field induction coil 3 is oriented normal to the cross current $I_c$ and therefore, the magnetic field B generated by the magnetic field induction coil 3 is able to interact with the cross current $I_c$ in order to generate a Lorentz force for launching a projectile.

The first conductive rail 1 and the second conductive rail 2 are positioned parallel to each other. As such, a Lorentz force generated from the interaction between the cross current $I_c$ and the magnetic field B in the magnetic field induction coil 3 is oriented parallel to the first conductive rail 1 and the second conductive rail 2. This allows a projectile driven by the movement of the magnetic field induction coil 3 to travel freely in between the first conductive rail 1 and the second conductive rail 2. The magnetic field induction coil 3 is positioned offset from the at least one conductive sheet 4, enabling the magnetic field induction coil 3 to freely move. The magnetic field induction coil 3 is positioned in between the first conductive rail 1 and the second conductive rail 2 in order to allow the magnetic field induction coil 3 to move parallel to the first conductive rail 1 and the second conductive rail 2 due to the Lorentz force.

Figure 2:
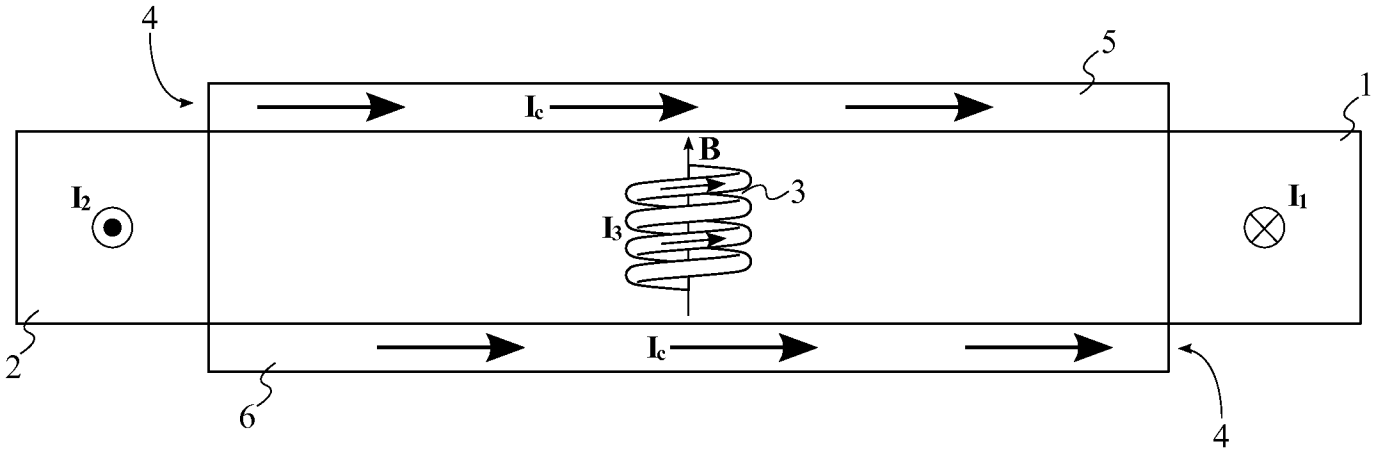
FIG. 2 is a front view electrical schematic diagram of the present invention showing the two conductive sheets.

As shown in FIG. 2, in the preferred embodiment of the present invention, the at least one conductive sheet 4 comprises a first conductive sheet 5 and a second conductive sheet 6. This enables the cross current $I_c$ to be divided equally into the first conductive sheet 5 and the second conductive sheet 6. The first conductive sheet 5 and the second conductive sheet 6 are oriented parallel to each other and thus, the cross current $I_c$ is able to interact with the magnetic field B in the magnetic field induction coil 3 in order to generate a Lorentz force. The magnetic field induction coil 3 is positioned in between the first conductive sheet 5 and the second conductive sheet 6, enabling the magnetic field induction coil 3 to freely move. The first conductive rail 1 and the second conductive rail 2 are positioned in between the first conductive sheet 5 and the second conductive sheet 6. As such, the first electrical current $I_1$ and the second electrical current $I_2$ are able to divide equally into the first conductive sheet 5 and the second conductive sheet 6. Thus, the first conductive sheet 5 and the second conductive sheet 6 are electrically connected across the first conductive rail 1 and the second conductive rail 2.

Again with reference to FIG. 1, the present invention further comprises a rail power supply 7. The rail power supply 7 is able to provide direct current (DC) electrical power to the first conductive rail 1 and the second conductive rail 2. The rail power supply 7 is electrically connected across the first conductive rail 1 and the second conductive rail 2 in order to form a loop of current through the first conductive rail 1, the at least one conductive sheet 4, and the second conductive rail 2.

Figure 3:
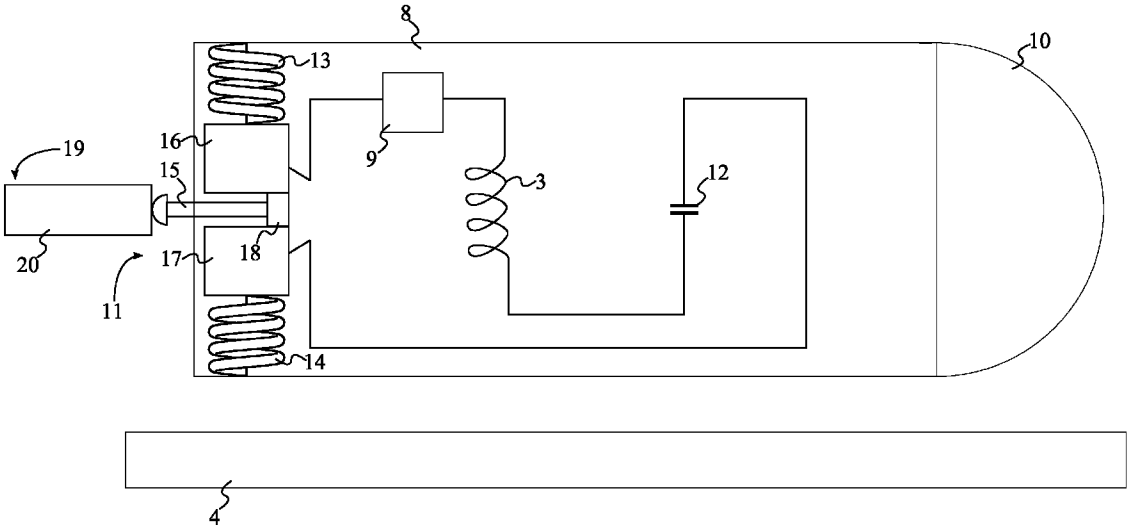
FIG. 3 is a side view schematic diagram of the present invention in a primed configuration.
Figure 4:
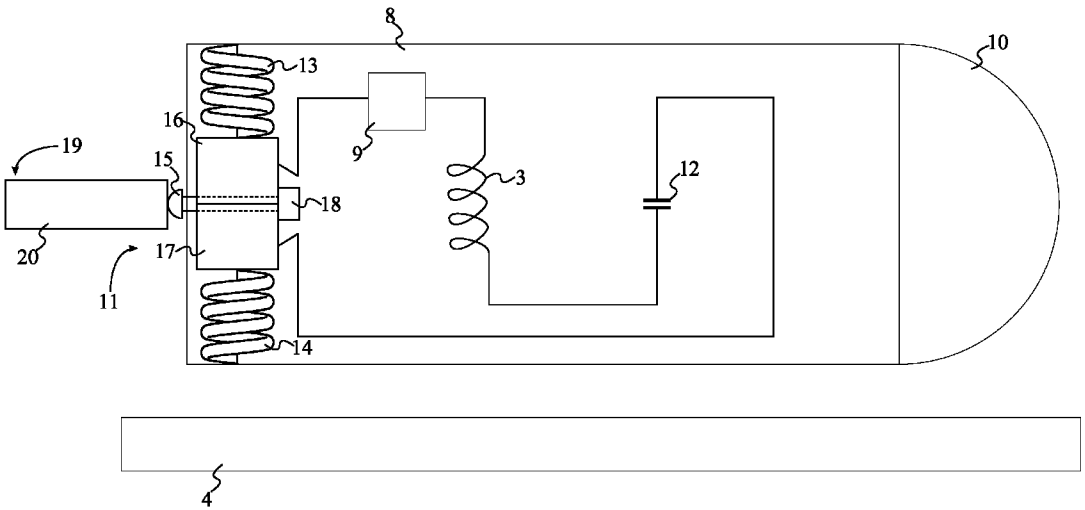
FIG. 4 is a side view schematic diagram of the present invention in a fired configuration.

The present invention further comprises a projectile case 8 as shown in FIG. 3 and FIG. 4. The projectile case 8 serves as a housing for the components of the projectile. Because the projectile is launched due to a Lorentz force, the magnetic field induction coil 3 is mounted within the projectile case 8. As such, when the magnetic field induction coil 3 is moved due to a Lorentz force, the projectile case 8 is able to move as well. The projectile case 8 is offset from the at least one conductive sheet 4, preventing unnecessary friction between the projectile case 8 and the at least one conductive sheet 4. In its preferred embodiment, the present invention further comprises a warhead 10. The warhead 10 is non-explosive in nature and is designed to provide penetrating capability to the projectile. The warhead 10 is adjacently connected to the projectile case 8 and is the component that initially comes into contact with a target after the projectile is launched.

In order to generate a Lorentz force, magnetic field B must be generated in the magnetic field induction coil 3. As such, the present invention further comprises a coil power supply 9. The coil power supply 9 provides DC electrical power to the magnetic field induction coil 3. In the preferred embodiment of the present invention, the projectile is a self-contained unit and, as such, the coil power supply 9 is mounted within the projectile case 8. The coil power supply 9 is electrically connected to the magnetic field induction coil 3 in order to drive the third electrical current $I_3$ through the magnetic field induction coil 3 and consequently generate the magnetic field B.

The present invention further comprises a firing assembly 11 that initiates the projectile launching process. The firing assembly 11 comprises an ultra capacitor 12, a first spring 13, a second spring 14, a push rod 15, a first electrical contact 16, and a second electrical contact 17. The first spring 13 and the second spring 14 are laterally mounted within the projectile case 8 in order to position the components of the firing assembly 11 within the self-contained unit of the projectile. The first spring 13 and the second spring 14 are oriented towards each other. Additionally, the first electrical contact 16 is mounted adjacent to the first spring 13, opposite the projectile case 8, while the second electrical contact 17 is mounted adjacent to the second spring 14, opposite the projectile case 8. This allows the first spring 13 and the second spring 14 to push the first electrical contact 16 and the second electrical contact 17 toward each other. The push rod 15 is slidably positioned in between the first electrical contact 16 and the second electrical contact 17. The push rod 15 serves to separate the first electrical contact 16 and the second electrical contact 17 prior to launching the projectile in order to prevent completing the circuit for the magnetic field induction coil 3. The push rod 15 may be slid out of place from in between the first electrical contact 16 and the second electrical contact 17 in order to allow the first electrical contact 16 to come into contact with the second electrical contact 17 and complete the circuit for the magnetic field induction coil 3. The push rod 15 partially traverses out of the projectile case 8 in order to allow the push rod 15 to be actuated from outside the projectile case 8.

Typically, a very large current is required in order to accelerate the projectile to the desired velocity. The ultra capacitor 12 is suitable for this application as the present invention requires a large amount of power for a short period of time. The ultra capacitor 12 stores and releases the very large amount of energy required to launch the projectile. In the preferred embodiment of the present invention, the ultra capacitor 12 and the magnetic field induction coil 3 are electrically connected in series between the first electrical contact 16 and the second electrical contact 17. This allows the first electrical contact 16, the second electrical contact 17, the ultra capacitor 12, and the magnetic field induction coil 3 to form a circuit that, when completed, generates a magnetic field B that interacts with the cross current $I_c$. The resulting Lorentz force causes the projectile to rapidly accelerate.

The present invention further comprises a pneumatic cylinder 19 that is utilized to actuate the push rod 15 and initiate the launch process. The pneumatic cylinder 19 is externally positioned to the projectile case 8 and thus may be utilized to launch multiple projectiles. A plunger 20 of the pneumatic cylinder 19 is pressed against the push rod 15. The pneumatic cylinder 19 is able to generate a reciprocating motion that forces the push rod 15 to slide from between the first electrical contact 16 and the second electrical contact 17, completing the circuit and launching the projectile.

With reference to FIG. 3, the first electrical contact 16, the second electrical contact 17, and the push rod 15 are shown in a primed configuration. The primed configuration is the configuration of the present invention prior to completion of the circuit formed by the first electrical contact 16, the second electrical contact 17, the ultra capacitor 12, and the magnetic field induction coil 3. The firing assembly 11 further comprises a wedge 18 that physically separates the first electrical contact 16 and the second electrical contact 17 in order to prevent completion of the circuit. As such, in the primed configuration, the wedge 18 is positioned in between the first electrical contact 16 and the second electrical contact 17. The wedge 18 is adjacently connected to the push rod 15, allowing the wedge 18 to slide in between the first electrical contact 16 and the second electrical contact 17 along with the push rod 15. The first electrical contact 16 is pressed against the wedge 18 by the first spring 13 while similarly, the second electrical contact 17 is pressed against the wedge 18 by the second spring 14. Because the first spring 13 and the second spring 14 are oriented toward each other, the first spring 13 and the second spring 14 are able to push the first electrical contact 16 and the second electrical contact 17 toward each other when the push rod 15 and the wedge 18 are removed from between the first electrical contact 16 and the second electrical contact 17.

The first electrical contact 16, the second electrical contact 17, and the push rod 15 are shown in a fired configuration in FIG. 4. The fired configuration is the configuration of the present invention after completion of the circuit formed by the first electrical contact 16, the second electrical contact 17, the ultra capacitor 12, and the magnetic field induction coil 3. The completion of the circuit generates magnetic field B that interacts with the cross current $I_c$ in the at least one conductive sheet 4. Because the magnetic field induction coil 3 is positioned within the projectile case 8, the interaction of the magnetic field B and the cross current $I_c$ generates a Lorentz force that propels and rapidly accelerates the projectile. In the fired configuration, the wedge 18 is positioned adjacent to the first electrical contact 16 and the second electrical contact 17 rather than in between the first electrical contact 16 and the second electrical contact 17. This is accomplished by sliding the push rod 15 until the wedge 18 is freed from in between the first electrical contact 16 and the second electrical contact 17. Because the wedge 18 is no longer separating the first electrical contact 16 and the second electrical contact 17, the first electrical contact 16 is pressed against the second electrical contact 17 by the first spring 13 and the second spring 14. When the first electrical contact 16 is pressed against the second electrical contact 17, the first electrical contact 16 is electrically connected to the second electrical contact 17 and the circuit is completed, generating magnetic field B.

Figure 5:
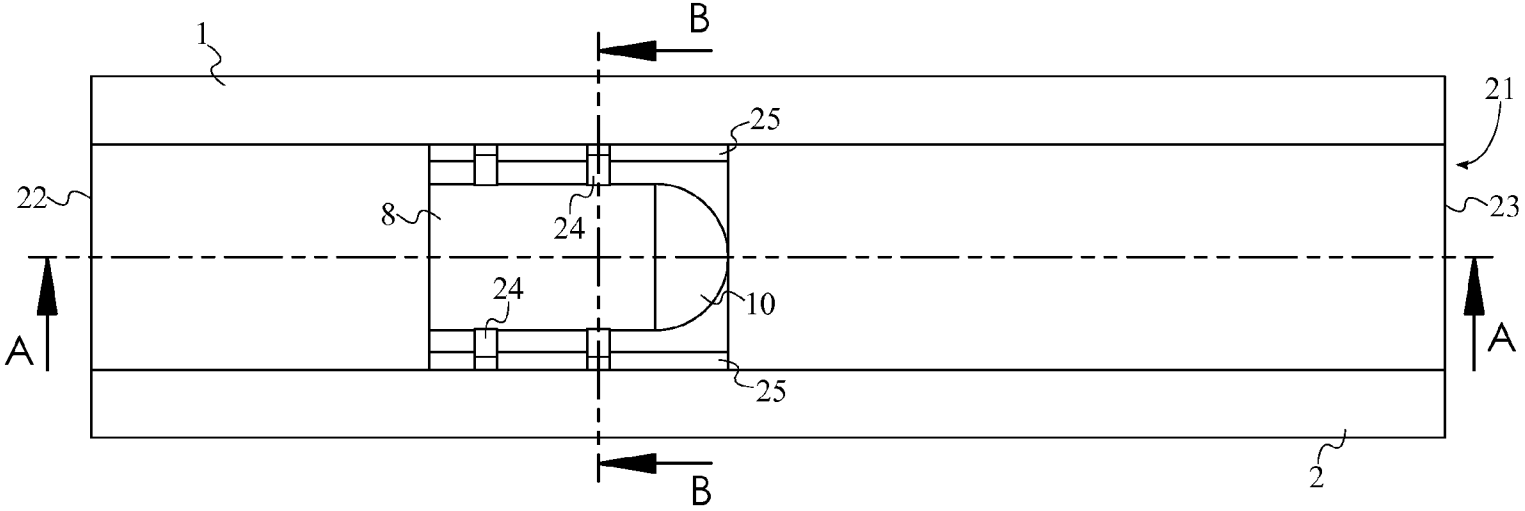
FIG. 5 is a top view schematic diagram of the present invention.
Figure 6:
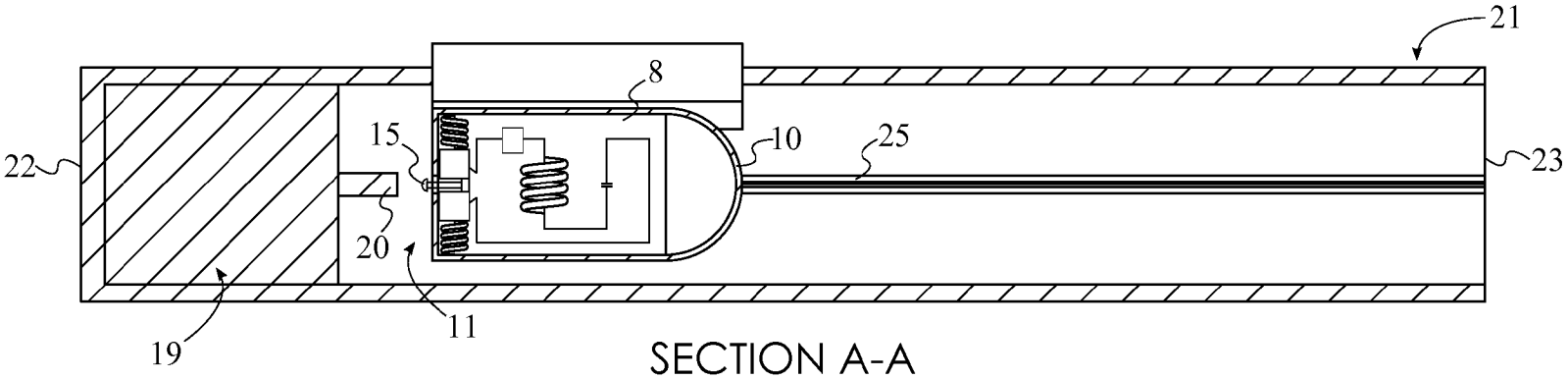
FIG. 6 is a cross-sectional schematic diagram of the present invention taken along line A-A of FIG. 5.
Figure 7:
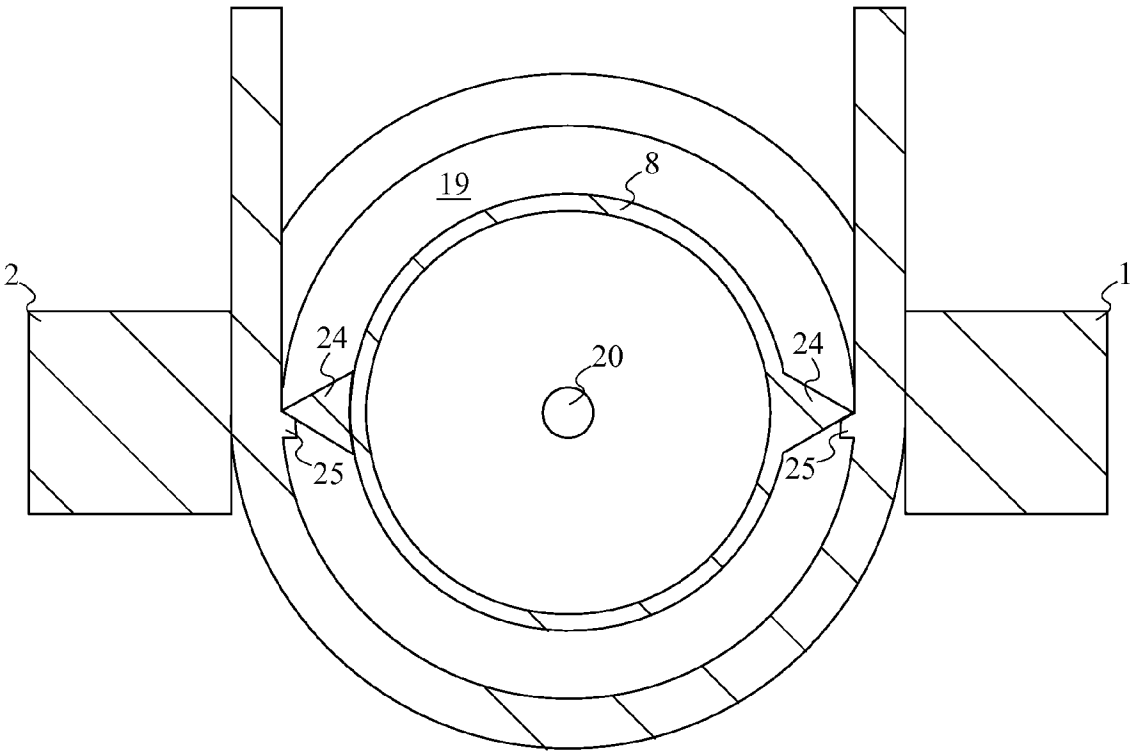
FIG. 7 is a cross-sectional schematic diagram of the present invention taken along line B-B of FIG. 5.

With reference to FIGS. 5-7, the present invention further comprises a launch tube 21, a plurality of guide fins 24, and a plurality of guide tracks 25. The launch tube 21 is the barrel from which the projectile is launched by the Lorentz force generated by the interaction between the magnetic field B and the cross current $I_c$. The plurality of guide fins 24 and the plurality of guide tracks 25 ensure that the projectile maintains a straight trajectory prior to reaching the muzzle velocity for straight free flight upon exiting the launch tube 21. The projectile case 8 is slidably positioned within the launch tube 21, allowing the projectile case 8 to pass through the launch tube 21 unimpeded when the projectile case 8 is fired. The first conductive rail 1 and the second conductive rail 2 are externally mounted to the launch tube 21 in order to position the first conductive rail 1 and the second conductive rail 2 in close proximity to the projectile case 8 within the launch tube 21.

The plurality of guide tracks 25 is internally connected along the launch tube 21 in order to guide the projectile case 8 along the length of the launch tube 21 prior to the projectile case 8 exiting the launch tube 21. The plurality of guide tracks 25 is radially distributed about the launch tube 21 as well in order to secure the projectile case 8 to the plurality of guide tracks 25 at multiple points. The plurality of guide fins 24 is externally connected along the projectile case 8 and are additionally radially distributed about the projectile case 8. The plurality of guide fins 24 is configured to correspond to the plurality of guide tracks 25. Each of the plurality of guide fins 24 is engaged to a corresponding track from the plurality of guide tracks 25. This allows the plurality of guide fins 24 to slide along the plurality of guide tracks 25, thus enabling the projectile case 8 to slide within the launch tube 21.

The launch tube 21 comprises a closed end 22 and a muzzle end 23 that are opposing ends of the launch tube 21. The muzzle end 23 is the end of the launch tube 21 through which the projectile case 8 exits the launch tube 21. The pneumatic cylinder 19 is mounted within the launch tube 21, adjacent to the closed end 22. This enables the pneumatic cylinder 19 to engage the firing assembly 11 without impeding the path of the projectile case 8 after the Lorentz force is generated. In the preferred embodiment of the present invention, the pneumatic cylinder 19 utilizes compressed gas to produce a reciprocating linear force in order to move a piston toward the push rod 15. As such, the projectile case 8 is positioned in between the pneumatic cylinder 19 and the muzzle end 23. Once the push rod 15 is actuated by the force of the pneumatic cylinder 19, the first electrical contact 16 and the second electrical contact 17 are electrically connected and the circuit is completed. The interaction between the magnetic field B and the cross current $I_c$ generates the Lorentz force that propels the projectile case 8 along the plurality of guide tracks 25 through the launch tube 21.

Although the present invention has been explained in relation to its preferred embodiment, it is understood that many other possible modifications and variations can be made without departing from the spirit and scope of the present invention as hereinafter claimed.

What is claimed is:

1. An electromagnetic tube gun comprises:

a first conductive rail, wherein a first electrical current travels along the first conductive rail;

a second conductive rail, wherein a second electrical current travels along the second conductive rail and travels in an opposite direction to the first electrical current;

an at least one conductive sheet, wherein a cross current travels across the at least one conductive sheet and travels in a perpendicular direction to both the first electrical current and the second electrical current;

a magnetic field induction coil, wherein a third electrical current travels around the magnetic field induction coil and generates a magnetic field oriented normal to and away from the at least one conductive sheet;

the first conductive rail and the second conductive rail being positioned parallel to each other;

the first conductive rail being electrically connected to the second conductive rail by the at least one conductive sheet;

the at least one conductive sheet being positioned in between the first conductive rail and the second conductive rail;

the magnetic field induction coil being positioned offset from the at least one conductive sheet; and the magnetic field induction coil being positioned in between the first conductive rail and the second conductive rail.

2. The electromagnetic tube gun as claimed in claim 1 further comprises:

the at least one conductive sheet comprises a first conductive sheet and a second conductive sheet;

the first conductive sheet and the second conductive sheet being oriented parallel to each other;

the magnetic field induction coil being positioned in between the first conductive sheet and the second conductive sheet; and the first conductive rail and the second conductive rail being positioned in between the first conductive sheet and the second conductive sheet.

3. The electromagnetic tube gun as claimed in claim 1 further comprises:

a rail power supply; and the rail power supply being electrically connected across the first conductive rail and the second conductive rail.

4. The electromagnetic tube gun as claimed in claim 1 further comprises:

a projectile case;

the magnetic field induction coil being mounted within the projectile case; and the projectile case being offset from the at least one conductive sheet.

5. The electromagnetic tube gun as claimed in claim 1 further comprises:

a coil power supply;

the coil power supply being mounted within a projectile case; and the coil power supply being electrically connected to the magnetic field induction coil.

6. The electromagnetic tube gun as claimed in claim 1 further comprises:

a warhead; and the warhead being adjacently connected to a projectile case.

7. The electromagnetic tube gun as claimed in claim 1 further comprises:

a projectile case;

a firing assembly;

the firing assembly comprises an ultra capacitor, a first spring, a second spring, a push rod, a first electrical contact, and a second electrical contact;

the first spring being laterally mounted within the projectile case;

the second spring being laterally mounted within the projectile case;

the first spring and the second spring being oriented towards each other;

the first electrical contact being mounted adjacent to the first spring, opposite the projectile case;

the second electrical contact being mounted adjacent to the second spring, opposite the projectile case;

the ultra capacitor and the magnetic field induction coil being electrically connected in series between the first electrical contact and the second electrical contact;

the push rod being slidably positioned in between the first electrical contact and the second electrical contact; and the push rod traversing into the projectile case.

8. The electromagnetic tube gun as claimed in claim 7 further comprises:

a pneumatic cylinder;

the pneumatic cylinder being externally positioned to the projectile case; and a plunger of the pneumatic cylinder being pressed against the push rod.

9. The electromagnetic tube gun as claimed in claim 7 further comprises:

wherein the first electrical contact, the second electrical contact, and the push rod are in a primed configuration;

the firing assembly further comprises a wedge;

the wedge being adjacently connected to the push rod;

the wedge being positioned in between the first electrical contact and the second electrical contact;

the first electrical contact being pressed against the wedge by the first spring; and the second electrical contact being pressed against the wedge by the second spring.

10. The electromagnetic tube gun as claimed in claim 7 further comprises:

wherein the first electrical contact, the second electrical contact, and the push rod are in a fired configuration;

the firing assembly further comprises a wedge;

the wedge being adjacently connected to the push rod;

the wedge being positioned adjacent to the first electrical contact and the second electrical contact;

the first electrical contact being pressed against the second electrical contact; and the first electrical contact being electrically connected to the second electrical contact.

11. The electromagnetic tube gun as claimed in claim 1 further comprises:

a launch tube;

a plurality of guide fins;

a plurality of guide tracks;

a projectile case being slidably positioned within the launch tube;

the first conductive rail and the second conductive rail being externally mounted to the launch tube;

the plurality of guide tracks being internally connected along the launch tube;

the plurality of guide tracks being radially distributed about the launch tube;

the plurality of guide fins being externally connected along the projectile case;

the plurality of guide fins being radially distributed about the projectile case; and each of the plurality of guide fins being engaged to a corresponding track from the plurality of guide tracks.

12. The electromagnetic tube gun as claimed in claim 11 further comprises:

the launch tube comprises a closed end and a muzzle end;

a pneumatic cylinder being mounted within the launch tube, adjacent to the closed end; and the projectile case being positioned in between the pneumatic cylinder and the muzzle end.

13. An electromagnetic tube gun comprises:

a first conductive rail, wherein a first electrical current travels along the first conductive rail;

a second conductive rail, wherein a second electrical current travels along the second conductive rail and travels in an opposite direction to the first electrical current;

an at least one conductive sheet, wherein a cross current travels across the at least one conductive sheet and travels in a perpendicular direction to both the first electrical current and the second electrical current;

a magnetic field induction coil, wherein a third electrical current travels around the magnetic field induction coil and generates a magnetic field oriented normal to and away from the at least one conductive sheet;

a rail power supply;

a projectile case;

a coil power supply;

the first conductive rail and the second conductive rail being positioned parallel to each other;

the first conductive rail being electrically connected to the second conductive rail by the at least one conductive sheet;

the at least one conductive sheet being positioned in between the first conductive rail and the second conductive rail;

the magnetic field induction coil being positioned offset from the at least one conductive sheet;

the magnetic field induction coil being positioned in between the first conductive rail and the second conductive rail;

the rail power supply being electrically connected across the first conductive rail and the second conductive rail;

the magnetic field induction coil being mounted within the projectile case;

the projectile case being offset from the at least one conductive sheet;

the coil power supply being mounted within the projectile case; and the coil power supply being electrically connected to the magnetic field induction coil.

14. The electromagnetic tube gun as claimed in claim 13 further comprises:

the at least one conductive sheet comprises a first conductive sheet and a second conductive sheet;

the first conductive sheet and the second conductive sheet being oriented parallel to each other;

the magnetic field induction coil being positioned in between the first conductive sheet and the second conductive sheet; and the first conductive rail and the second conductive rail being positioned in between the first conductive sheet and the second conductive sheet.

15. The electromagnetic tube gnu as claimed in claim 13 further comprises:

a warhead; and the warhead being adjacently connected to the projectile case.

16. The electromagnetic tube gun as claimed in claim 13 further comprises:

a firing assembly;

the firing assembly comprises an ultra capacitor, a first spring, a second spring, a push rod, a first electrical contact, and a second electrical contact;

the first spring being laterally mounted within the projectile case;

the second spring being laterally mounted within the projectile case;

the first spring and the second spring being oriented towards each other;

the first electrical contact being mounted adjacent to the first spring, opposite the projectile case;

the second electrical contact being mounted adjacent to the second spring, opposite the projectile case;

the ultra capacitor and the magnetic field induction coil being electrically connected in series between the first electrical contact and the second electrical contact;

the push rod being slidably positioned in between the first electrical contact and the second electrical contact; and the push rod traversing into the projectile case.

17. The electromagnetic tube gun as claimed in claim 16 further comprises:

a pneumatic cylinder;

the pneumatic cylinder being externally positioned to the projectile case; and a plunger of the pneumatic cylinder being pressed against the push rod.

18. The electromagnetic tube gun as claimed in claim 16 further comprises:

wherein the first electrical contact, the second electrical contact, and the push rod are in a primed configuration;

the firing assembly further comprises a wedge;

the wedge being adjacently connected to the push rod;

the wedge being positioned in between the first electrical contact and the second electrical contact;

the first electrical contact being pressed against the wedge by the first spring; and the second electrical contact being pressed against the wedge by the second spring.

19. The electromagnetic tube gun as claimed in claim 16 further comprises:

wherein the first electrical contact, the second electrical contact, and the push rod are in a fired configuration;

the firing assembly further comprises a wedge;

the wedge being adjacently connected to the push rod;

the wedge being positioned adjacent to the first electrical contact and the second electrical contact;

the first electrical contact being pressed against the second electrical contact; and the first electrical contact being electrically connected to the second electrical contact.

20. The electromagnetic tube gun as claimed in claim 13 further comprises:

a launch tube;

a plurality of guide fins;

a plurality of guide tracks;

the launch tube comprises a closed end and a muzzle end;

the projectile case being slidably positioned within the launch tube;

the first conductive rail and the second conductive rail being externally mounted to the launch tube;

the plurality of guide tracks being internally connected along the launch tube;

the plurality of guide tracks being radially distributed about the launch tube;

the plurality of guide fins being externally connected along the projectile case;

the plurality of guide fins being radially distributed about the projectile case;

each of the plurality of guide fins being engaged to a corresponding track from the plurality of guide tracks;

a pneumatic cylinder being mounted within the launch tube, adjacent to the closed end; and the projectile case being positioned in between the pneumatic cylinder and the muzzle end.

* * * * *